United States Patent [19]

Dardaine

[11] 4,248,028

[45] Feb. 3, 1981

[54] GRID FOR GUIDING RECEPTACLES AND SEIZING HEAD EQUIPPED WITH SUCH A GRID

[75] Inventor: Edgar Dardaine, Sorel-Moussel, France

[73] Assignee: E. P. Remy et Cie, Dreux, France

[21] Appl. No.: 24,413

[22] Filed: Mar. 27, 1979

[30] Foreign Application Priority Data

Jan. 22, 1979 [FR] France ..... 79 01516

[51] Int. Cl.[3] ..... B65B 39/02

[52] U.S. Cl. ..... 53/248; 53/262

[58] Field of Search ..... 53/248, 247, 261, 262

[56] References Cited

U.S. PATENT DOCUMENTS

| | | | |
|---|---|---|---|
| 3,271,928 | 9/1966 | Wild | 53/248 |
| 3,788,034 | 1/1974 | Hartness et al. | 53/248 |
| 3,911,647 | 10/1975 | Hartness et al. | 53/248 |
| 4,033,095 | 7/1977 | Wild | 53/248 |
| 4,035,986 | 7/1977 | Clem et al. | 53/248 X |
| 4,075,819 | 2/1978 | Raudat et al. | 53/248 |
| 4,171,603 | 10/1979 | Wiseman | 53/261 X |

*Primary Examiner*—Horace M. Culver

*Attorney, Agent, or Firm*—Kenyon & Kenyon

[57] ABSTRACT

This invention essentially relates to a grid for guiding bottles advancing towards compartments of a packing case. The grid has vertically fastened thereto supports each including a sleeve containing axial-push means together with a rod cooperating therewith to resiliently maintain a group of short fingers while imparting to their free ends a spaced apart position under the action of the axial push.

6 Claims, 4 Drawing Figures

GRID FOR GUIDING RECEPTACLES AND SEIZING HEAD EQUIPPED WITH SUCH A GRID

The present invention relates essentially to a grid for guiding receptacles, suitable for use, for example, in a seizing head for a machine for automatic handling of bottles, flasks or the like.

There are already known seizing heads comprising a plurality of bottle gripping members together with a grid movable in vertical translation with, or with respect to, the said members and the function of which is, in particular, to guide the bottles.

Such a seizing head is more particularly intended for use in bottle encasing and uncasing machines.

This type of seizing head known at present is designed mainly to withdraw or introduce the bottles from or into semi-rigid packing cases, such as for example cases or boxes of cardboard, plastics material, etc, internally provided with compartments which also are formed of cardboard or plastics material. Now such compartments often happen to be deformed, that is to say, their walls are not strictly vertical, so that the bottom of the bottles introduced into the compartmented case or box meets and therefore crushes or tears the said walls. This results in considerable defects and lost time and material.

In order to facilitate the introduction of the bottles into such packing cases of cardboard or the like, the use has been proposed of a grid combined with the gripping members of the seizing head and carrying bottle guiding elements, each constituted by a support provided with a group of movable fingers or the like, the free ends of which are permanently forced to a spaced apart position. Thus, by placing the groups of fingers above the compartments, more precisely right above the intersection of the partitions defining the said compartments, means are obtained for centering and guiding the bottles, which will necessarily penetrate into the compartments without any risk of the partitions or walls defining the said compartments being damaged, even if the said walls are at the outset deformed and/or distributed non-uniformly and unsymmetrically in the compartmented cases.

It has been found, however, that the guiding fingers used hitherto, as well as the return means associated with the said fingers, are not entirely satisfactory from the point of view of the reliability of the guiding of the bottles into the compartments.

The purpose of the present invention is therefore to remedy the above drawbacks by providing a grid carrying groups of fingers and in which the means for holding and forcing the groups of fingers to their spaced apart position operate necessarily in a reliable manner and, moreover, allow the use of short fingers forced to a position much spaced from one another.

To this end, the invention relates generally to a grid for guiding receptacles, such as bottles, flasks or the like, of the type comprising bottle guiding elements, each including a support provided with a group of movable fingers, the free ends of which are permanently forced to a spaced apart position, the said grid being characterized in that the support for the fingers comprises a sleeve containing axial-push means together with a rod cooperating with these means to resiliently retain the short fingers while at the same time imparting to their free ends the aforesaid spaced apart position under the action of the said axial push.

It is therefore understood that it is by an axial pressure on the fingers that the latter are maintained at the end of the support and forced to the position much spaced from one another.

According to another characterizing feature of the invention, the said axial-push means comprise a spring pressing down on a ring arranged to abut against the end of the sleeve, the said spring and the said ring being arranged in coaxial relationship to the said rod.

According to one embodiment, the end of the said rod forms a cruciform head constituting a corresponding number of cavities for the said fingers.

According to still another characterizing feature of the invention, the fingers are provided at their end retained within the sleeve with a slot, notch or the like cooperating with a shoulder forming the said abutment at the end of the sleeve, as well as bearing surfaces cooperating with the ring and the end or head of the rod.

According to another characterizing feature, the said rod mounted slidingly within the sleeve is keyed to the latter and is rigidly connected to the said grid.

It should also be noted that the sleeve may be provided with four fingers or with only two fingers, in which case the end or head of the rod may be of substantially T-shaped cross section.

Use is made of only two fingers or even a single finger for the compartments formed partially by the walls of the compartmented cardboard case, i.e. the compartments at the internal periphery of the case.

In that case, according to the invention, there can be provided on the sleeve a fin or like projection for guiding the latter along the wall of the compartmented case.

The invention is also directed to seizing heads comprising gripping members and equipped with grids provided with fingers complying with the aforementioned features.

Other characterizing features and advantages of the invention will appear more clearly as the following detailed description proceeds with reference to the appended drawings, FIG. 1 is a top view of a compartmented case or box of cardboard or the like showing the group of fingers supported by the grid right above the compartments of the case;

Figure 1:
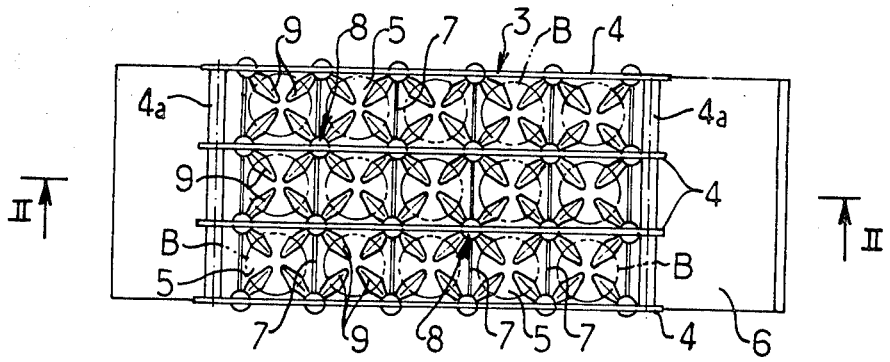
Figure 2:
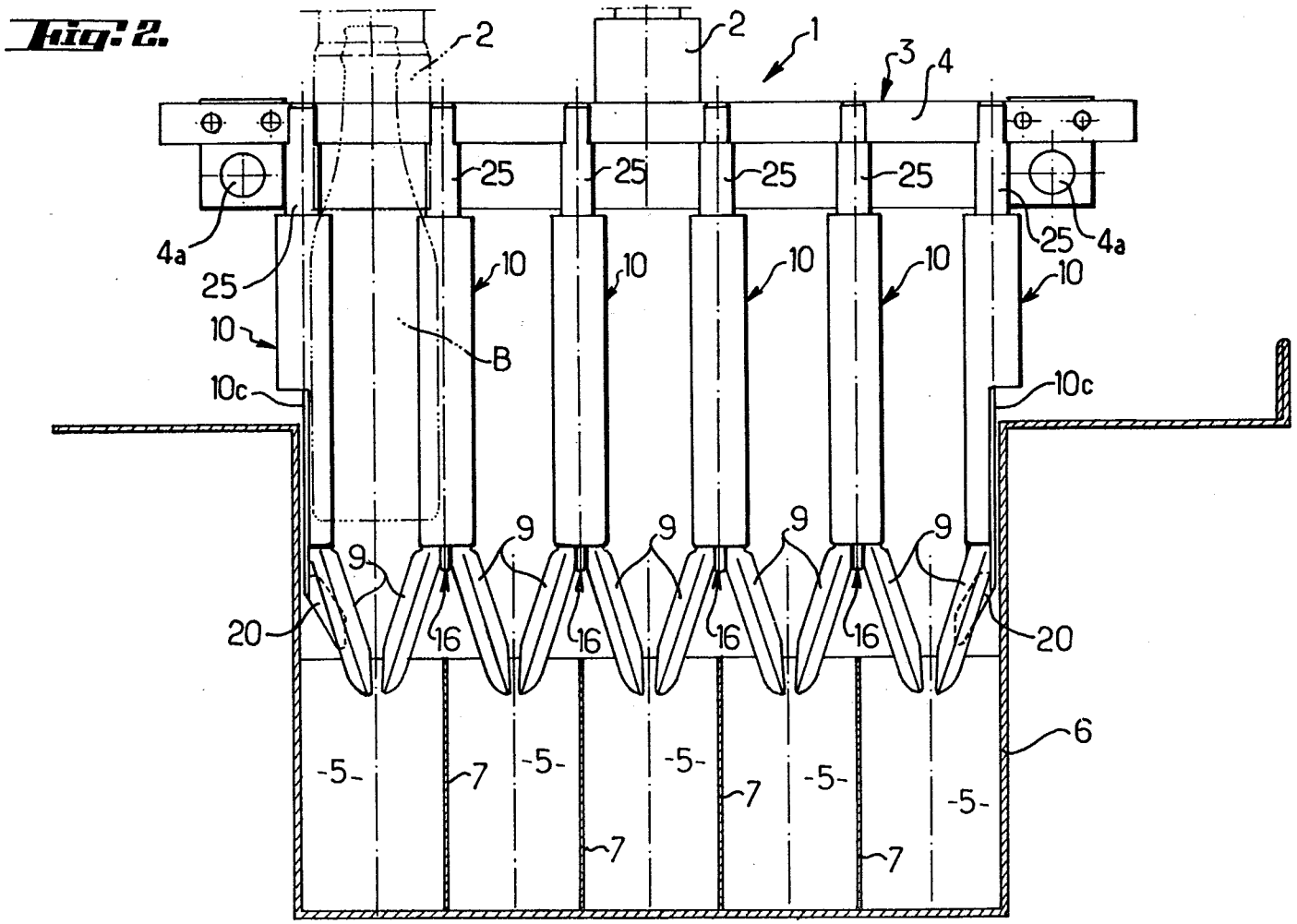
FIG. 2 is a diagrammatic elevational view of a seizing head located above a compartmented case and comprising a grid supporting groups of fingers according to the invention.

According to the embodiment illustrated in FIGS. 1 and 2, a seizing head 1 comprising gripping members 2 of cylindrical shape is provided with a grid 3, the openings of which are for example polygonal in shaped, formed of bars, strips or the like 4 and 4*a* secured at right angles. The side of each opening is slightly greater than the diameter of the members 2 and the bottles B which it is desired to withdraw from or introduce into a compartmented case, box or the like 6, for example of cardboard, comprising compartments 5 formed by parallel and perpendicular partitions 7 which may be of cardboard or any other suitable material.

The grid 3, in a manner known per se, is movable in vertical translation with, or with respect to, the gripping members 2, and the openings of the grid 3 correspond substantially to the cross section of the compartments 5.

Figure 3:
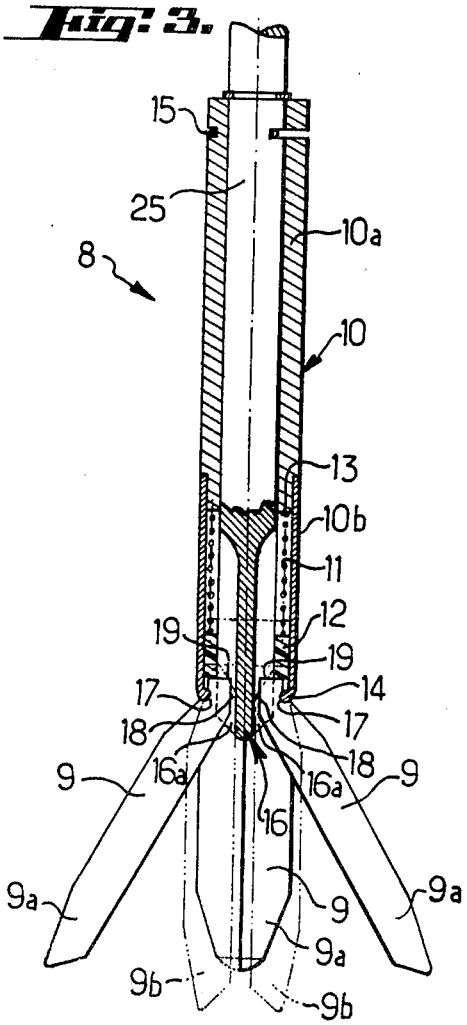
FIG. 3 is an axial sectional view of a support provided with four fingers.

The grid 3 is provided with supports 8 which constitute the essential subject matter of the present invention and which carry at their end fingers or the like 9 whose free ends 9*a* are permanently forced to a spaced apart position, as seen clearly in FIGS. 1 and 3.

According to the invention, each support 8 comprises a sleeve 10 having two portions, i.e. an upper portion 10*a* and a lower portion 10*b* the inner diameter of which is greater than that of the portion 10*a*, so as to provide a cavity for accommodating a spring 11 and a ring 12. The spring 11 bears upon the end 13 of the portion 10*a* and presses down on the ring 12 which is arranged to abut against a shoulder 14 formed at the end of the portion 10*b* of sleeve 10, when the fingers 9 are not mounted at the end of the said sleeve.

Figure 4:
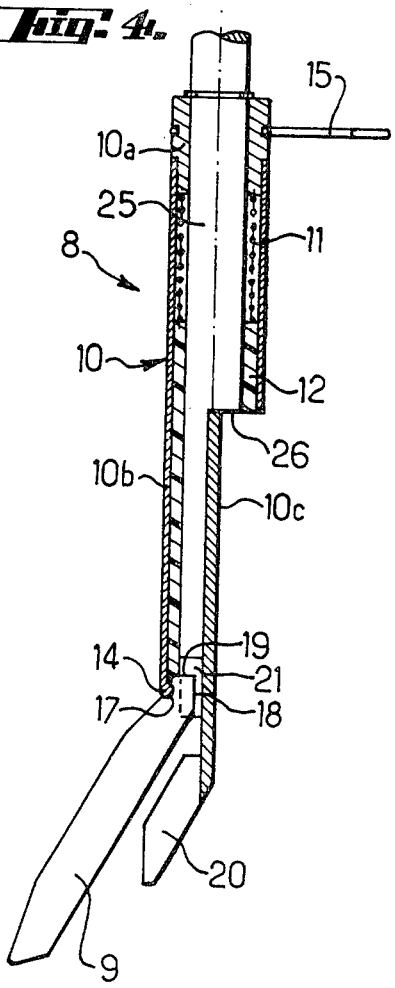
FIG. 4 is an axial sectional view of a support according to another form of embodiment and provided with two fingers.

As appears clearly from FIGS. 3 and 4, a rod 25 is slidingly mounted within the sleeve 10 and is secured to the latter by means of a cotter, pin or the like 15. The rod 25 projects from the upper end of the sleeve 10 and is fastened to the grid 3. The rod 25 also projects from the lower end of sleeve 10 and has an end 16 in the form of a cruciform head according to the embodiment illustrated in FIG. 3.

The fingers 9 are provided at their end retained in the portion 10*b* of the sleeve 10 with a slot or notch 17 arranged to receive the shoulder 14. This end of the fingers 9 also is formed with bearing surfaces 18 and 19 which cooperate with the head 16 of the rod 25 and with the ring 12, respectively.

Thus, according to the embodiment illustrated in FIG. 3, the cruciform head 16 defines four cavities or recesses 16*a*, each accommodating a finger 9 resiliently retained by the ring 12, the shoulder 14 and the walls forming the cruciform head 16. More precisely, the ring 12, under the action of the spring 11, presses down on the bearing surfaces 19, so that the fingers 9 are forced to a spaced apart position, as seen in FIG. 3. But, under the action of the bottle B passing between the supports 8, the fingers 9 rotate about the shoulder 14 at the end of the sleeve and, by retracting, assume the substantially vertical position shown at 9*b* in FIG. 3. The fingers 9 can retract easily since the bearing surfaces 19 push upwardly the ring 12 acted upon by the spring 11. Briefly, the axial push exerted by the spring 11 and the ring 12 resiliently forces the fingers 9, which are short, to the normal, much spaced position; while at the same time they are capable of retracting during the passage of the bottles B.

As seen in FIG. 1, the supports 8 with the fingers 9 according to the invention serve as a corresponding number of reliable systems for guiding and centering the bottles B in the compartments 5 when they are placed directly above the intersections of the partitions 7 forming the said compartments.

The form of embodiment of the support 8 illustrated in FIG. 4 is identical with that of FIG. 3, with the only difference being that it is provided with only two fingers 9 and that the lower portion of the sleeve 10 is slightly modified to form a flat portion 10*c* which slides along the side walls of the compartmented case 6, as seen in FIG. 2. As appears clearly from this Figure as well as from FIG. 1, the supports 8 provided with two fingers as shown in FIG. 4 are advantageously mounted on the sides of the grid 3.

It should also be added here that in order to additionally improve the guiding of the grid 3 above the compartmented case 6, there is provided a fin or like projection 20 at the end of the flat portion 10*c* of the finger support shown in FIG. 4.

Since only two fingers 9 are provided in the form of embodiment illustrated in this Figure, use can be made, instead of the cruciform head 16 shown in FIG. 3, of a head of substantially T-shaped cross-section, thus defining two cavities or recesses for the fingers on either side of the leg portion 21 of the T-section, the cross bar portion of T-section is formed by the flat portion 10*c*. Of course, as seen in FIG. 4, the portion 10*b* of the sleeve 10 as well as the ring 12 are shaped in an appropriate manner, i.e. taking into account the flat portion 10*c* which forms, in a way, a recess or offset 26 at the lower portion of the support 8.

There is therefore obtained according to the invention a system for guiding and centering bottles in a compartmented case or box, in which use can be made of short, resiliently retained fingers, pushed axially to a position much spaced from one another, the said system being mechanically simple, operating in an accurate and reliable manner, even when the compartments of the case are deformed, and being easily disassembled by simply removing the rod 25 from the sleeve 10.

Of course, the invention is by no means limited to the embodiments described and illustrated which have been given by way of example only. In particular it comprises all means comprising technical equivalents to the means described as well as their combinations should the latter be carried out according to its gist and used within the scope of the following claims.

I claim:

1. A grid packer for encasing containers such as bottles, said packer having an array of elements for guiding the containers into a carton, each element including a vertical support and at least one movable finger depending from the support, each finger having a free end which is resiliently forced to a position spaced from the axis of the support, wherein said support comprises:

a sleeve having a lower free end and a stop means spaced from said free end;

a ring slidably arranged within said sleeve adjacent the free end;

a spring coaxially arranged within the sleeve between the stop means and the ring, said spring resiliently urging the ring axially toward the free end of the sleeve; and means for supporting said at least one finger for pivotal motion about an axis adjacent to the free end of the sleeve and tangent to a circle coaxial with said sleeve, said ring contacting said finger for pivoting the free end thereof outwardly from the axis of the sleeve in response to the axial force exerted by said spring.

2. A grid packer according to claim 1, wherein said means for supporting each finger comprises a rod arranged within said sleeve in coaxial relation with said spring and said ring, the rod having one end projecting from said lower free end of the sleeve, and said one end comprising a cruciform head which defines recesses receiving each finger.

3. A grid packer according to claim 2, wherein said lower free end of the sleeve comprises shoulder means and each finger has an upper end retained within said lower end of the sleeve, said upper end of the finger having notch means cooperating with said shoulder means and a bearing surface cooperating with said ring for converting the axial force of said spring into radially outward pivoting movement of the free end of said finger.

4. A grid packer according to claim 1, wherein said rod is rigidly attached to the grid packer and has an upper portion mounted slidingly within the sleeve, and said support further comprises means for fastening said rod to the sleeve.

5. A grid packer according to claim 2, wherein the cruciform head of said rod has a substantially T-shaped cross-section.

6. A grid packer according to claim 1, wherein said lower free end of the sleeve is provided with a flat guiding surface and with a projection extending from said surface for guiding the grid packer into a carton.

* * * * *